United States Patent [19]

Horn et al.

[11] 4,412,427

[45] Nov. 1, 1983

[54] NONCONTACT THERMAL INTERFACE

[75] Inventors: Stuart B. Horn, Fairfax; Lundy H. McMillion, Fredericksburg; Howard L. Dunmire, Stafford; Geoffrey S. Sawyer, Annandale; William C. Gerkin, Vienna, all of Va.

[73] Assignee: The United States of America as represented by the Secretary of the Army, Washington, D.C.

[21] Appl. No.: 326,094

[22] Filed: Nov. 30, 1981

Related U.S. Application Data

[62] Division of Ser. No. 137,073, Apr. 3, 1980, Pat. No. 4,324,104.

[51] Int. Cl.[3] ..... F25D 19/00

[52] U.S. Cl. ..... 62/298; 62/514 R

[58] Field of Search ..... 62/514 R, 298; 250/352

[56] References Cited

U.S. PATENT DOCUMENTS

| | | | |
|---|---|---|---|
| 3,258,602 | 6/1966 | Promish | 62/514 R |
| 3,389,578 | 6/1968 | Pollack | 62/514 R |
| 3,611,746 | 10/1971 | Marsing et al. | 62/514 R |
| 3,702,932 | 11/1972 | Tanner et al. | 62/514 R |
| 3,807,188 | 4/1974 | Lagodmos | 62/514 R |
| 3,851,173 | 11/1974 | Taylor et al. | 62/514 R |
| 4,194,119 | 3/1980 | Mackenzie | 62/514 R |

*Primary Examiner*—Ronald C. Capossela

*Attorney, Agent, or Firm*—Robert P. Gibson; Milton W. Lee

[57] ABSTRACT

The invention relates to a thermal coupling assembly between the cold finger of a cryogenic cooler and a dewar enclosed detector for use at infrared and far infrared frequencies. The coupling provides excellent thermal coupling without solid or even liquid contact between the cold finger and the detector, so that no strain or vibration is transmitted therebetween.

5 Claims, 2 Drawing Figures

NONCONTACT THERMAL INTERFACE

The invention described herein may be manufactured, used, and licensed by the U.S. Government for governmental purposes without the payment of any royalties thereon.

This is a division of application Ser. No. 137,073, filed Apr. 3, 1980 now U.S. Pat. No. 4,324,104.

BACKGROUND OF THE INVENTION

1. Field of the Invention

The invention relates to thermal viewers and the like wherein solid state detectors, e.g. diodes, are cooled to temperatures such as the boiling point of nitrogen (approx. 77° K.), in order to detect thermal photons having wavelengths, in the range from 8–14 microns.

2. Description of the Prior Art

In the above viewers, the detectors are mounted in the vacuum between the inner and outer walls of a glass dewar which may, for example, be filled with liquid nitrogen. The detector is mounted on the inner wall which contacts the liquid nitrogen and faces the outer wall which is transparent to infrared or far infrared. While such viewers are dispensible in many field situations that arise in military actions, law enforcement and purely scientific endeavors; the need to supply liquid nitrogen severely limits the utility of these devices.

There has been considerable effort, therefore, to substitute some form of mechanical cooler in which the coolant is permanently sealed into the cooling system. Considerable success has been obtained with special designs of Stirling cycle and Villumeau coolers. The cooling function is directed toward the end of a cold finger that extends from the cooler. This finger extends into a well formed by the inner dewar wall and contacts the substantially flat circular portion of that wall at the bottom of the well which also contacts the detector inside the dewar. A rubber o-ring between the finger and a cylindrical portion of the well wall reduces convection losses from the interface.

An immediate problem is presented by the fact that the length of cold finger does not always equal the depth of the dewar well. It, therefore, has been necessary to make a portion of the cold finger out of elastic material. The material loses much of its elasticity at low temperature, but is still adequate to solve the problem thus far presented.

Another difficulty which has only been partially solved is the problem of mechanical vibrations in the cooler. Initially these vibrations were so severe that the presence of the cooler could be easily detected with relatively unsophisticated sound detection equipment even at fairly large distances. This has been greatly overcome by the use of balanced designs and more efficient cooling cycles. There still remains a small component of vibration which is transmitted to the dewar and detector. Aside from the stress problems this presents in these elements, which are already subjected to temperature stresses, this vibration also effects the quality of the image produced by the system. As will be seen the image resolution is degraded in an inverse relationshop to improvements that have been made in the detector.

SUMMARY OF THE INVENTION

The object of the present invention is to provide a special coupling between the cold finger of a mechanical cooler and the dewar of an infrared detector element for a thermal viewer, which virtual eliminates both the constant stress, required in the prior art to effect such a coupling, and the high frequency vibration transmitted through this coupling by the operation of the mechanical cooler.

BRIEF DESCRIPTION OF THE DRAWINGS

The invention is best understood with reference to the accompanying drawing wherein.

DESCRIPTION OF THE PREFERRED EMBODIMENT

Figure 1:
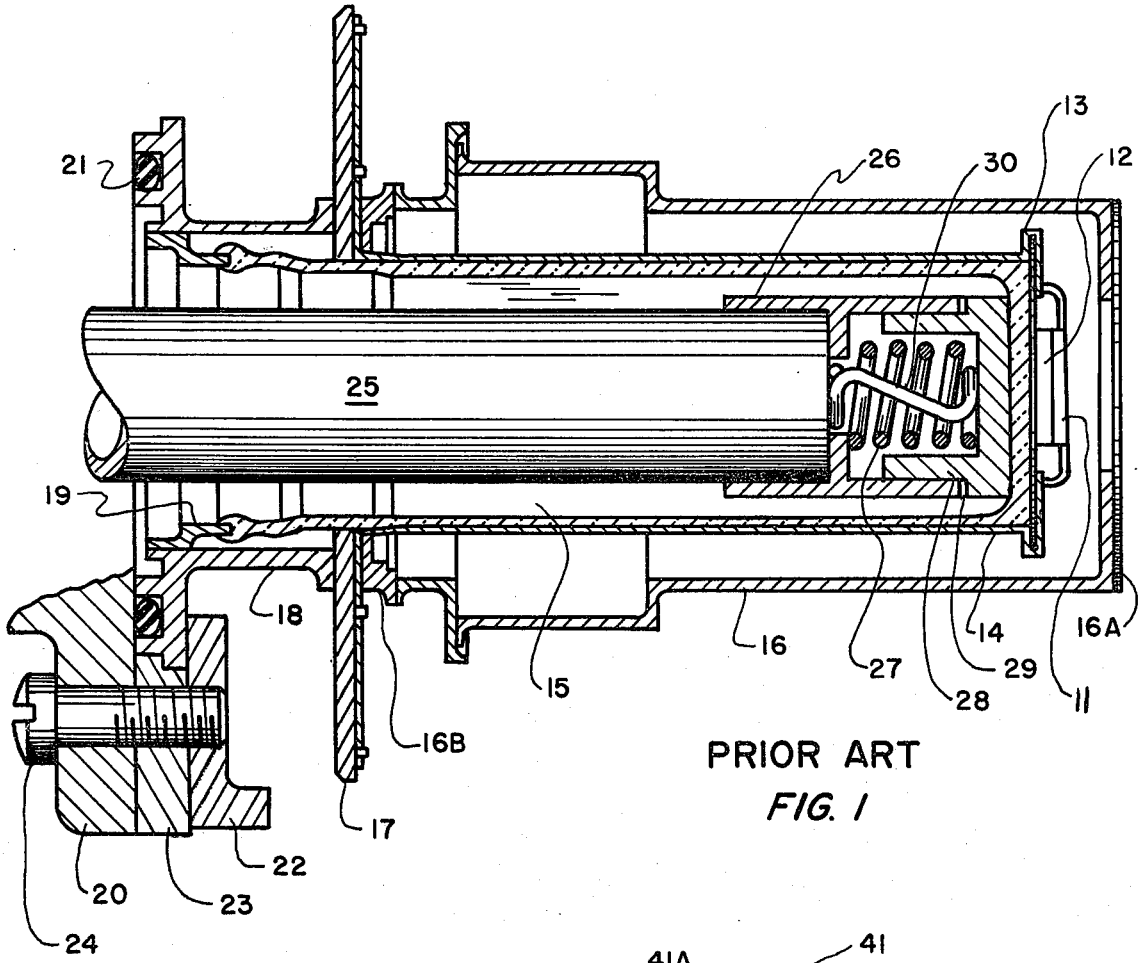
PRIOR ART FIG. 1
FIG. 1 shows a prior art coupling between a cold finger and a dewar.

Referring specifically to FIG. 1 there is shown a portion of a thermal viewer equipped with a mechanical cooler. The system uses a single line array 11 of infrared sensitive diodes made from gallium arsenide, gallium phosphide, lead-tin-telluride or mercury-cadmium telluride, for example. When cooled to about 77° K., the boiling point of nitrogen, these diodes are very sensitive to photon having wavelengths below 2 microns down to nearly 14 microns. The array is cemented to a mount 12 made from a good thermal conductor. The mount is in turn cemented to a larger glass or ceramic disc 13. Finally, the disc 13 is cemented to the glass inner wall 14 inside a dewar on a transverse circular end portion of an exterior well 15 defined by the inner wall. The detector faces a transverse circular end portion of an outer dewar wall 16 which must be either transparent to at least the far infrared or contain a window 16A for the detector that will pass the light frequencies to which it is sensitive. A plurality of conductive leads are plated on the circuit disc 13 and the inside surface of the inner wall. These leads are further plated on a glass or ceramic support washer 17 which extends outside of the dewar. The washer is fused to the inner wall of the dewar to form a vacuum tight seal and a ceramic or glass collar 16B seals the edge of the outer dewar wall 16 to the support washer in the same manner. The space between the two walls 14 and 16 is then evacuated in the usual manner using sealoff tabulations, getters and the like.

To connect the dewar to a cooling device a metal base structure is supplied herein shown as toroidal elements 18 and 19. A flange 20 of the cooling device abuts this base structure and engages an o-ring carried thereby to seal off the atmosphere in the well. Clamping members 22 and 23 are employed with machine screws 24 to hold the dewar and cooler structures together, the former clamping member being threaded to engage the machine screw.

When the two structures are engaged a cold finger 25 extends from the cooler through well 15 and presses on the exterior surface of the circular end wall on which the detector 11 is mounted. To compensate for the difference in expansion rates with temperature of the cold finger and the dewar, the well is made deeper than the length of the cold finger, which in turn is extended by a spring housing member 26 containing a compression spring 27 and a sliding cap 28. With the spring fully extended the entire cold finger assembly is slightly longer than necessary. When pressing against the dewar there is a small gap 29 between the opposed transverse edges of the cap and spring housing so that no stresses can be transmitted therebetween. A flexible conductor 30 is soldered between the cap and the end of the cold finger to provide a more efficient temperature coupling.

As previously mentioned a problem with this coupling is that it couples a vibration component from the cooler to the dewar. The cooler uses a low molecular weight coolant gas such as helium and involves very high working pressures. The various components of the cold finger and the dewar tend to become more stiff and brittle at low temperatures to add to this problem. As the size of the individual diodes is reduced and/or their numbers increased in order to reduce the overall size of the structure or to improve the resolution of the visible image produced, this vibration results in a blurring action which is clearly descernible as a flicker or a bar pattern running through the image or scene.

Figure 2:
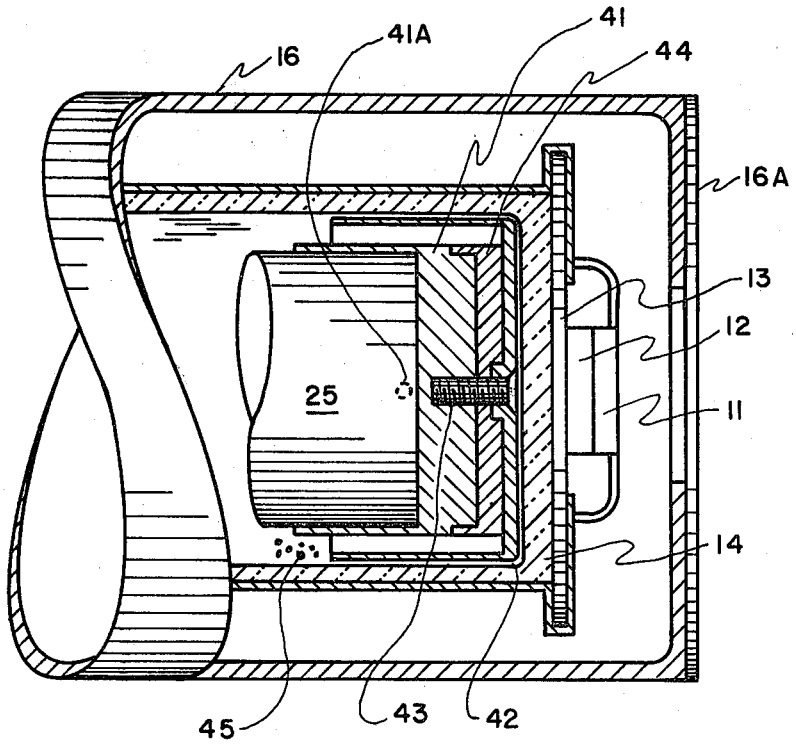
FIG. 2 shows the improved coupling element for the same elements as shown in FIG. 1 according to the present invention.

FIG. 2 shows a coupling structure according to the present invention for overcoming the problems previously mentioned. The coupling structure previously mounted on the end of the cold finger 25 is replaced by a cup shaped adapter 41 which slips onto the cold finger and a similar cup shaped special heat exchange coupling member 42. The heat exchange coupling member is fastened to the adapter by means of a flat head countersunk screw 43 passing through a hole in the middle of the heat exchange coupling and which is threaded into the adapter. A shim washer 44 may be inserted between these two members to adjust the overall length of the cold-finger-coupling combination. This will allow cold fingers and dewars having different design finger lengths and well depths to be used interchangeably. Due to the close fit between the adapter 41 and the cold finger 25, one or more holes 41A are drilled through the circularly cylindrical side wall of the former adjacent to the plane circular interface between these two members to release any gas or liquid trapped between them. The length of the complete cold finger structure is a critical factor in the present invention because there is no spring structure to relieve thermal stresses that occur should the finger and dewar touch. To avoid such stresses the special coupling member is given an outer contour which follows the inner contour of the well, but is spaced therefrom about one ten thousandth of an inch. This is more that the differential expansion of the glass well and the cold finger.

The loss in thermal conductivity due to the above spacing is offset in two ways. First, the special coupling member not only conductively and convectively (through the intervening gas or vapor) couples to the center of the circular end wall of the well, but extends to the relieved corners and a considerable distance down the cylindrical side walls as well. The effective coupling area is tripled when the coupling extends one radius along the inner cylindrical dewar wall normal to the circular end wall. Since the inner cylindrical wall also serves a path of heat flow into the dewar the efficiency of cooler will be diminished if the coupling extends beyond a certain distance. The second method for increasing the coupling involves the use of a hydrocarbon 45 which sublimes at the heat transfer point temperature. This vapor solid interface transfers heat by vapor transport and condensation between the two heat transfer surfaces. Useful materials for this purpose are acetone, ethyl or methyl alcohol, carbon tetrachloride, carbon dioxide. In addition, the use of an inert highly conductive gas will improve heat transfer over such an interface. One of the above materials is introduced into volume 15 as a gas or liquid and permitted to vaporize as the cold finger and dewar are assembled. The gas or vaporized hydrocarbon displaces much of the air between the cold finger and the dewar and is sealed therebetween by compression of the o-ring seal 21 shown in FIG. 1. When the temperature of the cold finger drops a heavy inert gas such as $CO_2$ or a hydrocarbon freezes out of the space between the contoured special coupling member and the dewar wall to greatly improve the coupling. An improved heat transport is provided between the solid phase which forms on the coupling and dewar surfaces and the intervening evaporated or sublimed phase therebetween. The lowest temperature of the detector in a system without the hydrocarbon has been found to be 60° K. but the same system provided a detector temperature of 38° K. using acetone as the gas in volume 15. In a system equivalent to that shown in FIG. 1, except the spring housing 26 was a bellow structure rather than overlapping tubes, a detector with individual diodes spaced 50 microns apart produced an image that was almost obliterated by a 5 kc vibration from a quiet well balanced cooler. Using the special coupling described herein, the vibration was barely discernible in the visible image.

While the additional coupling members added to the cold finger may number as many as three, it is obvious that these may be only one member, if desired. While the major thrust of the present device was to improve the resolution of an electronic detector, it will also permit the use of a thinner less conductive inner dewar wall to improve its thermal efficiency. It will also prolong the life of the coupling since the temper of a spring member subjected to repeated thermal cycles is no long a life factor. Other obvious structural modifications will be apparent to those skilled in the art, but the invention is limited only by the claims that follow.

We claim:

1. In a thermal viewer apparatus having a solid state detector mounted on the inside surface of the end wall of an exterior well in an evacuated dewar and a cooler with a cold finger extending into said well, the improvement comprising:

a heat exchange coupling member formed in the shape of a cup, with both the inner and outer configurations thereof similiarly shaped, for coupling the cold finger of the cooler to the inside bottom and end-wall portion of the external well of the dewar, wherein the inner portion of the cup-shaped coupling member fits over the cold finger of the cooler and wherein the cold finger with the cup-shaped member attached fits into the exterior well of the dewar, wherein the outer surface of the cup-shaped member substantially conforms to the size and shape of the inner dimensions of the exterior well of the dewar.

2. An apparatus according to claim 1 wherein:

a cup-shaped adapter member is interposed between the cold finger of the cooler and the heat exchange coupling member, has similar cup-shaped inner and outer configurations and functions to rigidly attach said heat exchange coupling member to said cold finger.

3. An apparatus according to claim 2 wherein:

a removeable shim member is inserted between said cup-shaped adapter member and said heat exchange coupling member whereby the length of said cold finger and couplings can be adjusted for different well depths of different dewars.

4. An apparatus according to claim 1 wherein:
a gaseous hydrocarbon is sealed in the external well of the dewar.

5. An apparatus according to claim 4 wherein:
said hydrocarbon is selected from a group consisting of acetone, ethyl alcohol, methyl alcohol, carbon tetrachloride and carbon dioxide.

* * * * *